United States Patent [19]

Rubik

[11] 4,378,116

[45] Mar. 29, 1983

[54] SPATIAL LOGICAL TOY

[75] Inventor: Ernö Rubik, Budapest, Hungary

[73] Assignee: Politoys Ipari Szövetkezet, Budapest, Hungary

[21] Appl. No.: 289,192

[22] Filed: Aug. 3, 1981

[30] Foreign Application Priority Data

Oct. 28, 1980 [HU] Hungary ..... 2598/80

[51] Int. Cl.[3] ..... A63F 9/08

[52] U.S. Cl. ..... 273/153 S

[58] Field of Search ..... 273/153 S, 155

[56] References Cited

FOREIGN PATENT DOCUMENTS 170062 2/1978 Hungary ..... 273/153 S

OTHER PUBLICATIONS

Scientific American, Mar. 1981, p. 39.

*Primary Examiner*—Anton O. Oechsle

*Attorney, Agent, or Firm*—Gabriel P. Katona

[57] ABSTRACT

A spatial logical toy is formed from a total of eighteen toy elements, out of which two sets of eight identical toy elements two connecting elements are provided. The elements of the two sets have cam members with hollows with spherical convex or concave surfaces in-between. The elements are connected by the aid of the cams and the two remaining centrally positioned substantially identical connecting elements each having a T-shape cross-section and when assembled the toy is in the form of a regular or an irregular solid. Fixation is performed by one single screw passing through bores in the connecting elements. In such a manner the toy elements forming the lateral faces of the spatial logical toy can be rotated along the spatial axes and by yielding several variation possibilities the toy is well suitable for stimulating logical thinking activity.

7 Claims, 12 Drawing Figures

SPATIAL LOGICAL TOY

BACKGROUND OF THE INVENTION

The invention relates to a spatial logical toy having a total of eighteen toy elements which form a regular or an irregular spatial body, preferably an oblong body, in the assembled state.

Spatial logical toys are well known, such as that described in the HU-PS No. 170 062 of the same applicant, which relates to a spatial logical toy consisting of twenty-seven solids which form a cube in the assembled state. The toy elements, in the shape of small cubes, may be turned along the spatial axes of the cube by means of connecting elements arranged in the geometric center of the large cube. The surfaces of the small cubes forming each surface of the large cube are colored or carry numbers, figures or any other symbols which can be assembled into the predetermined logical order of sequence by simultaneously rotating the nine toy elements forming the surfaces of the "large cube".

SUMMARY OF THE INVENTION

The logical toy according to the present invention represents an improved form of the previously described spatial logical toy.

The construction is based on the same principles, however, the internal connection is performed by means of absolutely new and particular solids.

By this it is meant that any six or nine toy elements out of the toy elements forming the surfaces of the rectangular solid body can be simultaneously rotated around any of the spatial axes of the solid. In such a manner the colors, figures, numbers or any other symbols (e.g. dominoes) on the outer surfaces of the toy elements forming the surface of the spatial logical toy according to the invention yield innumerable possible variations serving in particular for stimulating the logical thinking of teen-agers, simultaneously making possible the set up of rules of different indoor games, as well as the performance of the same.

The object of the invention is to develop a spatial logical toy, which is built up of a total of eighteen toy elements forming a solid (a regular or amorphous body), preferably a rectangular solid shaped body, in the assembled state, while the toy elements are mutually connected in the center of the solid without using separate connecting profiles, merely by the proper shape of the solids of the toy elements. Along the spatial axes of the spatial logical toy, six or nine toy elements can be simultaneously rotated, yielding the possibility of several variations of play by means of the symbols, numbers, colors etc. to be found on the outer surface, i.e. by the contents carried by them.

In accordance with the invention the object is achieved in such a manner, that out of the eighteen toy elements, two sets of eight toy elements are each shaped in an identical manner, while two identical toy elements are formed as to realize the central fixation of the toy elements. One corner of one side of one set of identically shaped eight toy elements, preferably small cubes, which faces the geometrical center of the assembled solid is formed as an articulated solid or cam which is connected mutually and adjoined to the two preferential toy elements and is fixed with one single spring screw to form the spatial logical toy according to the invention.

The key feature according to the invention, i.e. shape, mode of interconnection and central fixture will be described in detail by means of two preferred embodiments, by the aid of the accompanying drawings, wherein

DETAILED DESCRIPTION OF THE PREFERRED EMBODIMENTS

Figure 1:
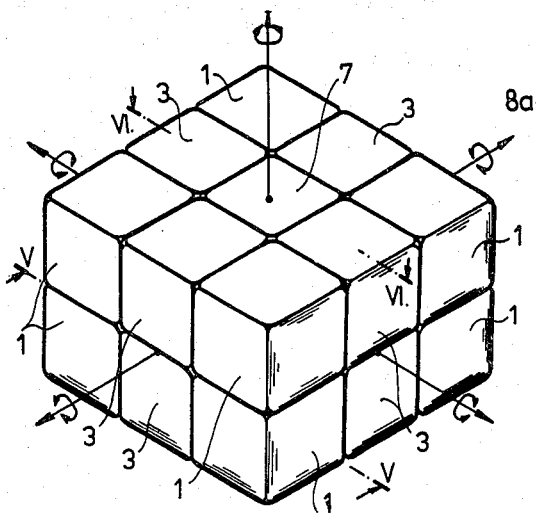
FIG. 1 shows the spatial logical toy in the assembled state.
Figure 4:
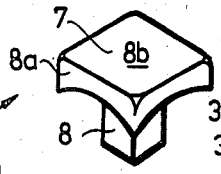
FIG. 4 is a plan view of one of the two toy elements serving for the central fixation.

Referring to FIGS. 1–6, toy shown in FIG. 1 includes eighteen toy elements, of which the eight identically shaped toy elements 1 belonging to the first group are cubes. To the edge of one of the corners of each of the cubes, a solid or cam 2 is connected. The solid 2 has two confining faces 2*a*, 2*b*, which lie at a predetermined unit distance from the surface of the cube and extend parallel to the confining faces 1*a*, 1*b* of the cube, accordingly, they are at right angles to each other. The third face 2*c* of the solid 2 lies in the same plane as the quadratic surface 1*c* at a given corner of the cube, thus the solid 2 has essentially the shape of a corner-profile and the faces lying parallel to the confining faces of the cube are confined by a curve 2*d*, 2*e* of the shape of a quarter of an ellipse, while the thickness of the face is equal to the unit distance measured from the cube. In such a manner the corner-profile forms a hollow with a curved surface and is connected to the cube via the solid adjoined to the two faces 1*a*, 1*b*.

Figure 3:
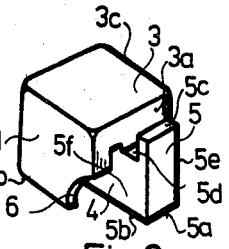
FIG. 3 is a plan view of one of the eight identically shaped toy elements belonging to the second group.
Figure 2:
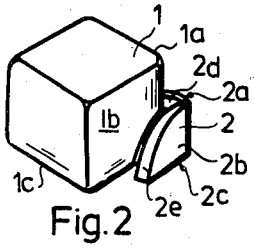
FIG. 2 shows a plan view one of the identical eight toy elements belonging to the first group.
Figure 5:
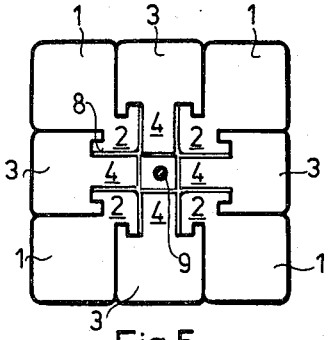
FIG. 5 is a cross-sectional view of the toy along line V—V in FIG. 1.
Figure 10:
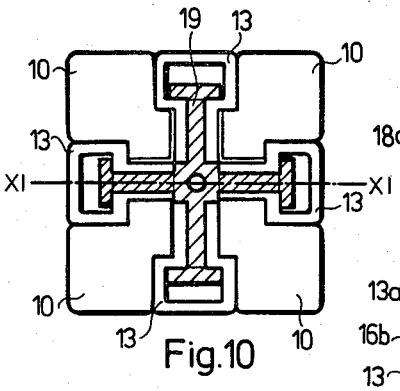
FIG. 10 is a cross-sectional view of the toy according to the second embodiment of the invention along line X—X in FIG. 11.
Figure 9:
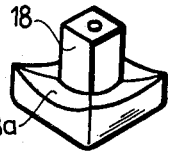
FIG. 9 is a plan view of one of the toy elements according to the second embodiment for providing connection between the toy elements.

The eight identically shaped toy elements 3 belonging to the second group are also dice-shaped, in fact they consist of a cube and a closely connected solid or cam 4 as shown in FIG. 3. The solid 4 lies at the previously chosen unit distance from one of the confining faces of the cube. One of the confining face 5 protruding from the plane of the cube, forms a plane surface running parallel with the confining face 3*a* of the cube, roughly it is rectangular, its lower borderline 5*a* is straight and closes a plane 5*b* being identical with the lower confining plane 3*b* of the cube. The upper borderline 5*c* is curved, while the milling with a parallel convex curved surface ensures the preselected unit distance, accordingly, the thickness of the face 5*d* lying next to the milling will be of the same dimension. The third and fourth confining faces 5*e*, 5*f* of the solid are planes running parallel with the corresponding lateral faces 3*c*, 3*d* of the cube and they are joined to the frontal face of the cube via the hollow formed with the convex surface being in compliance with the dimension having been selected as the unit distance. In such a manner, the other sides of said hollow are formed by the opposite lying faces of the cube, the corners of which being cut-off by the concave curved line 6.

Figure 6:
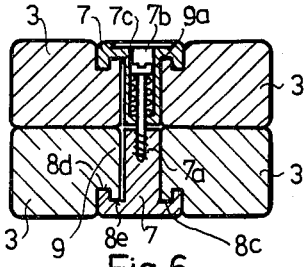
FIG. 6 is a cross-sectional view of the toy along line VI—VI in FIG. 1.
Figure 11:
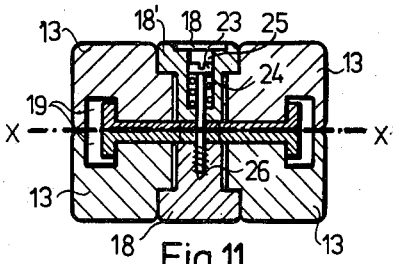
FIG. 11 is a cross-sectional view along line XI—XI in FIG. 10.
Figure 7:
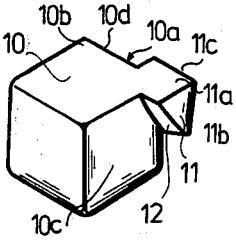
FIG. 7 is a plan view of a second embodiment of one of the eight identical toy elements belonging to the first group.

The third group of the toy elements of the logical toy according to the invention comprises two substantially identical toy elements 7,7′, which are arranged in the middle-part of the solid as shown in FIG. 6. These elements appear in the side-view with a T-shape including a thick vertical shank. The vertical shank of the T-shape is formed by the prism 8 with a quadratic base, while the horizontal shank of the T-shape is formed by a solid 8*a*, having a square base 8*b* in the top-view. The size of the square 8*b* corresponds to the size of the sides of the cubes forming the aforementioned two toy elements. Along the circumference of the prism there is a curved groove 8*c*, the size of which corresponds to the preselected unit distance, while the width of the horizontal "shank" 8*d* has been selected so that the upper part of the rectangle 5*c* confined by a curved convex line, formed by the solid of the toy element 3 belonging to the second group, protruding from one of the confining planes of the cube, being separated from said confining face of the cube by the convex hollow 5*d* selected as the unit, should accurately fit into the hollow 8*e* next to the horizontal shank of the T-shape and in such a manner, that the confining faces 3*c*, 8*b* below the fitted parts of the solids should lie in the same plane.

Fixation is performed by the screw 9 enclosed by the spring 9*a*, which is screwed into the threaded bore 7*a* of the centrally located toy element 7, the screw 9 also passing through the through-bore 7*b* of the opposite lying, substantially identically shaped toy element 7′. The throughbore 7*b* is accessed by means of removable lid 7*c* in base 8*b*. The toy is assembled in such a manner, that the toy element 7 provided with the threaded bore 7*a* is placed onto the solid part forming the horizontal shank of the T-shape. After having fitted the oblong protruding part of the toy elements 3 confined by a curved line into the hollows of the toy element 7 running parallel with the lateral faces of the quadratic prism, the four sides are connected. In such a manner a complex solid in form of a Greek cross is obtained. Hereafter the two halves are fitted together, the screw 9 with the spring 9*a* is passed through the through-bore 7*b* of the toy-element 7′ and screwed into the threaded bore 7*a* of the toy element 7. Thereafter the bore 7*b* on the toy-element 7′ is closed by means of the closely fitted lid 7*c*.

In such a manner the logical toy according to the invertion forms an indissoluble unity. By connecting the hollows with the curved surfaces, the toy elements 1, 3 can be rotated in any direction of the spatial axes of the logical toy. Complete fixation is performed by means of one single screw and connection between the toy elements, in a rotatable but simultaneously indissolubly manner, can be achieved by means of the solids themselves.

A further preferable embodiment of the spatial logical toy can be built up of the following toy-elements as shown in FIGS. 7–12.

The toy element 10 belonging to the first group (FIG. 7) includes a cube 10*a*, at the corner of which the solid or cam 11 has been arranged. One of the confining faces 11*a* of the solid 11 lies coplanar with the confining face 10*b* of the cube, while the further two confining faces 11*b*, 11*c* are protruding plane surfaces which simultaneously run parallel with the surfaces 10*c*, 10*d* of the cube. The third and fourth confining faces are formed by the curved convex surfaces 12, as a consequence, the solid 11 forms a V-shaped extension at the corner of the cube.

Figure 8:
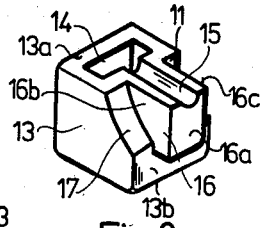
FIG. 8 is a plan view of the second embodiment of one of the toy elements belonging to the second group.

The toy-element 13 belonging to the second group is an articulated solid and has been essentially deduced from a cube (FIG. 8). In one of the confining surfaces 13*a* of the cube there is the hollow 14 and the channel 15 with a semi-circular profile running perpendicularly to the hollow 14, but its length continues for the full length of the solid and protrudes from the plane of the other confining face 13*b* of the cube. One of the confining faces 16*a* of the protruding solid or cam 16 is formed by a plane running parallel with the confining face 13*b* of the cube, to which planes 16*b*, 16*c* running parallel with each other are joined on both sides and next to them the sides of the cube are milled with the concave connecting surfaces 17.

The toy element 18, 18′ representing the connecting elements (FIG. 9) are substantially identical with the solids having been previously described in connection with the first embodiment of the invention (FIG. 4), except that the surface 18*a* is a spherical segment confining surface with no hollow between it and the shank.

Figure 12:
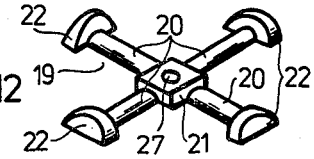
FIG. 12 is a plan view of the intersecting axes member for fixing the toy elements.

FIG. 12 shows one intersecting axes member 19. Each member 19 has intersecting axes formed by the four half cylinders 20 connected to the centrally located flat prism 21 and by the half discs 22 arranged at the ends of the cylinders 20, integrally formed therewith. The intersecting axes members 19 fit into the hollows 14, and their cylindrical portions fit into the channels 15.

Assembly is performed in the same manner as previously described in connection with the first embodiment. The screw 23 enclosed by the spring 24 is screwed into the bore 25 passing through the connecting element 18′ and accessed through lid 18*a*, the bore 26 in element 18 and the centrally positioned prism bores 27 of the intersecting axes members 19. After having tightened the screw 23, the toy becomes unreleasable and can be disassembled only after the removal of the screw. Rotation becomes possible, similarly with respect to the first embodiment, in any direction along the spatial axes of the spatial logical toy.

By rotating the toy element several variations may be obtained.

The greatest advantages of the invention lies in that on the surface of the toy-elements relief-like configurations (symbols, figures, letters etc.) may be formed, as a consequence a toy may be created for blind people being absolutely equivalent with the logical toy for those with perfect eyesight.

For the purpose of expendience, the toy elements forming the spatial logical toy, in particular cubes, may be produced from synthetic material by injection molding. In order to save material, the elements may be prepared as hollow elements.

What is claimed is:

1. In a spatial logical toy assembled from a plurality of toy elements, of which a predetermined number may be rotated in the direction of the spatial axes starting from the geometrical center of the logical toy, the improvement wherein the spatial logical toy is formed by a total of eighteen toy elements, of which two sets of eight toy elements each comprise substantially cubiforms with integally formed cam elements and each of the sets comprise eight identical toy elements, and two connecting toy elements, and means for joining the connecting toy elements to coact with the cam elements to form an integrated toy body, the joining means comprising a single screw enclosed by a spring.

2. The spatial logical toy as claimed in claim 1, wherein the toy has the shape of a regular geometrical body in the assembled state, the toy elements thereof belonging to one set comprise eight cubiform homologous elements each having a first cam element connected to one corner thereof, two confining surfaces of which lie at a unit distance from two surfaces of the cube and are parallel therewith and are cut-off in the form of an ellipsis-quarter, and a third confining surface thereof is coplanar with another surface of the cube and between the two confining faces of the first cam element running parallel with the cube and the cube there is a hollow with a convex spherical surface.

3. The spatial logical toy as claimed in claim 2, wherein the eight identically shaped cubiform toy elements belonging to the other set of toy elements each include a second cam element including a rectangular solid element extending from the plane of one of the faces of the cube at said unit distance from said one face of the cube, the rectangular solid element having an upper curved convex borderline and between the cube and the rectangular solid there is a hollow with a curved surface, third and fourth confining faces of the cam element are formed by planes running parallel with the corresponding lateral faces of the cube and between the cube faces and the planes there are hollows with a convex surface, the other sides of the hollow being formed by the faces of the cube lying opposite to each other and the corners of the planes are cut-off along a curved line.

4. The spatial logical toy as claimed in claim 3, wherein the two connecting elements are formed by two substantially identically shaped toy elements each consisting of a prism with a quadratic base and a connected solid element having a quadratic base, groove with a concave surface disposed along the circumference of the prism in the solid element, the quadratic base of the solid element being the same size as the quadratic confining surfaces of the cubes of the toy elements belonging to the first and the second sets, wherein one of the connecting elements has a throughbore and the other has a threaded bore in the prismatic part and wherein the two elements are interconnected by the screw enclosed by the spring.

5. The spatial logical toy as claimed in claim 1, wherein the toy-elements belonging to the first set comprise cubes provided with a protruding cam at one of the corners, one of the confining faces of the cam lies coplanar with one of the confining faces of the cube, two further confining surfaces of the cam are planes extending parallel to corresponding confining faces of the cube and third and fourth confining faces of the solid are each formed by a convex curved surface.

6. The spatial logical toy as claimed in claim 5, wherein the identically shaped toy elements belonging to the second set are articulated solids of generally cubic shape wherein on one of the confining faces of the cube there is a hollow and a semi-circular channel runs perpendicularly to same and the length of the channel continues along the full length of the solid and protrudes from another confining face of the cube, the frontal confining face of the solid runs parallel to a corresponding confining face of the cube, while on both sides thereof there are confining planes adjoining concave connecting surfaces of the cube.

7. The spatial logical toy as claimed in claim 6, wherein the joining means further comprises two intersecting axes members each comprising semi-cylinders, semi-discs fixed onto the end of said cylinders and a flat prism with a central throughbore.

* * * * *